US007980315B2

(12) United States Patent
Bolding et al.

(10) Patent No.: US 7,980,315 B2
(45) Date of Patent: Jul. 19, 2011

(54) SYSTEM AND METHOD FOR SELECTIVELY COMMUNICATABLE HYDRAULIC NIPPLES

(75) Inventors: Jeffrey L. Bolding, Kilgore, TX (US); Dewayne Turner, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 479 days.

(21) Appl. No.: 12/049,871

(22) Filed: Mar. 17, 2008

(65) Prior Publication Data

US 2009/0229834 A1 Sep. 17, 2009

(51) Int. Cl.
*E21B 34/10* (2006.01)

(52) U.S. Cl. ..... 166/375; 166/320; 166/319; 166/374; 166/386; 166/382

(58) Field of Classification Search ..... 166/382, 166/275, 73, 320, 319, 374, 375, 386
See application file for complete search history.

(56) References Cited

U.S. PATENT DOCUMENTS 4,294,315 A 10/1981 Yonker et al.

FOREIGN PATENT DOCUMENTS

WO WO 2006133351 * 12/2006 ..... 166/322
WO WO 2007073401 * 6/2007 ..... 166/305.1

OTHER PUBLICATIONS

Office Action issued in related foreign patent application CA 2,657,546.

* cited by examiner

*Primary Examiner* — Daniel P Stephenson
*Assistant Examiner* — Yong-Suk Ro
(74) *Attorney, Agent, or Firm* — Zarian Midgley & Johnson PLLC

(57) ABSTRACT

A selectively communicatable hydraulic nipple is provided which includes an upper and lower communications component adapted to communicate with tools landed inside the hydraulic nipple. Each communications component communicates with a control line used by the hydraulic nipple. An operator is allowed to selectively communicate with tools landed inside the nipple via the upper and lower communications components via the nipple control line. As a result, should the TRSCSSV control line loose integrity, the operator has the option of utilizing the nipple control line to continue oil and gas production without the need for well modifications. Alternatively, an operator could land a chemical injection tool, with an injection string suspended therefrom, in the nipple and inject chemicals into the well via the nipple control line.

19 Claims, 3 Drawing Sheets

SYSTEM AND METHOD FOR SELECTIVELY COMMUNICATABLE HYDRAULIC NIPPLES

BACKGROUND OF THE INVENTION

1. Field of the Invention

The present invention relates generally to hydraulic nipples used in oil and gas wellbores and, more particularly, to hydraulic nipples adapted to selectively operate as a chemical injection site and/or as a landing site for a wireline retrievable surface control subsurface safety valve.

2. Description of the Related Art

It is often desirable in the oilfield industry to deploy a hydraulic nipple as an integral component of the production tubing at the time of completion or workover. The hydraulic nipple is typically used for the insertion and retrieval of a Wireline Retrievable Surface Controlled Subsurface Safety Valve ("WRSCSSV") in the event the Tubing Retrievable Surface Controlled Subsurface Safety Valve ("TRSCSSV") is no longer operable or safety redundancy is needed. A typical hydraulic nipple consists of a lock profile, a single communication port and at least two polished bores which straddle the communication port. The communication port is attached to an external control line, which provides surface control or hydraulic communication to the surface.

There are drawbacks in the traditional nipple design. When the initial completion runs the additional hydraulic nipple, below the safety valve, the control line becomes a leak path around the safety valve. The communication port, having no in line check valve to surface must be isolated off by installing an isolation sleeve, effectively sealing off formation pressure from transmitting around the uphole safety valve and back to the surface. An in-line check valve would render the hydraulic nipple system unacceptable for use as a landing location for a WRSCSSV since releasing the pressure at surface would not allow the valve to close due to trapped pressure between the valve and the check valve.

It is sometimes desirable to inject chemicals downhole for treating the well and/or well systems. In the case of a well which has a TRSCSSV or a WRSCSSV, the hydraulic nipple becomes a good landing location for a chemical injection suspension sleeve and capillary string, since capillary can not be ran from surface through the production pipe, which would render the up-hole safety valve non-functional. In order to accomplish this, costly wellhead modifications are typically necessary since a passageway for the injection string has not previously been provided within the tubing hanger and/or wellhead assembly. This is obviously a time consuming, and thus costly, limitation to the present use of hydraulic nipples. In addition, present day well assemblies generally have a single control line used to operate the TRSCSSV. In the event the control line looses integrity, a complete workover, wherein at least a part of the production tubing is pulled, is required to replace the control line and/or TRSCSSV.

In view of these disadvantages, there is a need in the art for an improved hydraulic nipple and well assembly adapted to selectively facilitate the subsequent injection of chemicals downhole or the insertion of a WRSCSSV without the need to modify the wellhead.

SUMMARY OF THE INVENTION

According to one embodiment of the present invention, a hydraulic nipple is provided which is adapted for selective downhole communication with tools landed inside the nipple. The hydraulic nipple includes a bore extending therethrough. The bore has an upper and lower annular flow channel extending around its interior surface. An upper and lower communications component extends from the housing of the hydraulic nipple into the upper and lower annular flow channels of the bore, respectively. The upper and lower communications components communicate with a control line of the nipple via a first and second communications conduit, respectively. During the life of the well, tools, such as a chemical injection tool and/or a WRSCSSV can be landed inside the nipple, such that they are allowed to communicate with the communications components. In the most preferred embodiment, the chemical injection tool is allowed to communicate with the lower communications component while the WRSCSSV communicates with the upper communications component. As such, an operator can selectively communicate with the tools via the upper and lower communications components.

According to another embodiment of the present invention, the hydraulic nipple includes a check valve along the second communications conduit to prevent fluid flow in an uphole direction. As such, a chemical injection tool can be landed inside the nipple and allowed to communicate with the second communications conduit while avoiding the danger of downhole fluids escaping the well via the second communications conduit.

An exemplary method of the present invention includes the steps of positioning the hydraulic nipple within the wellbore beneath a TRSCSSV or a WRSCSSV and selectively communicating with the tool via the second control line. The TRSCSSV or WRSCSSV is allowed to communicate with a first control line and the hydraulic nipple communicates with a second control line. The method may further include the steps of loosing integrity in the first control line, inserting a WRSCSSV into the nipple and communicating with the WRSCSSV via the second control line.

Yet another exemplary method of the present invention includes the steps of positioning the hydraulic nipple within a wellbore, the hydraulic nipple comprising a first and second communications component in communication with a first control line, and communicating a first fluid through the first control line and into the second communications component. The method may further include the step of subsequently communicating a second fluid through the first control line and into the first communications component.

The foregoing summary is not intended to summarize each potential embodiment or every aspect of the subject matter of the present disclosure. Other objects and features of the invention will become apparent from the following description with reference to the drawings.

Figure 1A:
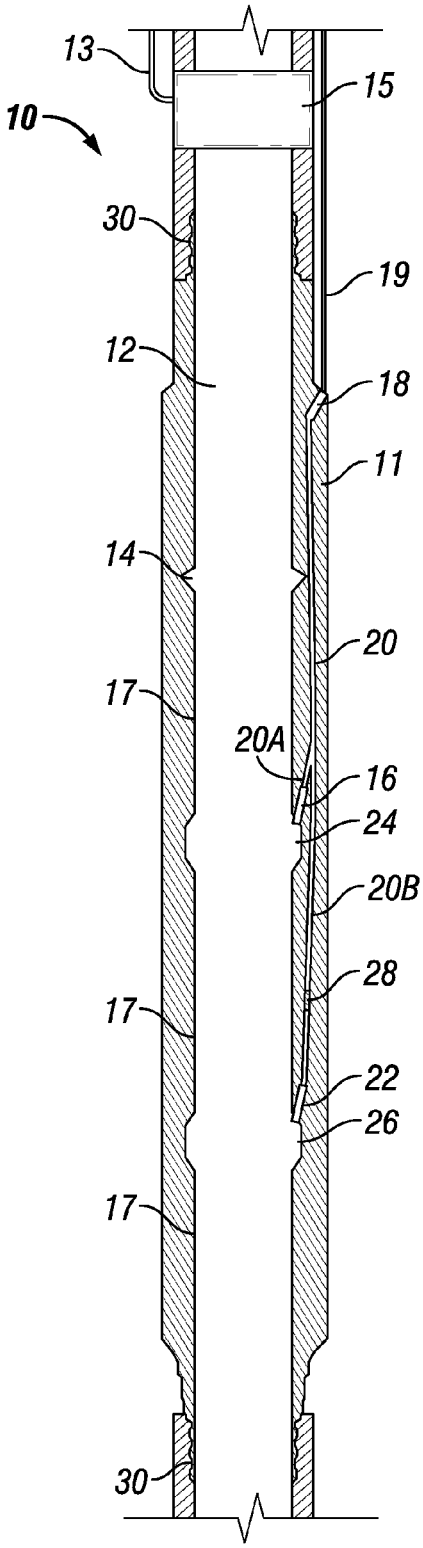
FIG. 1A is a cross-sectional view of an exemplary embodiment of the selectively communicatable hydraulic nipple of the present invention.

While the invention is susceptible to various modifications and alternative forms, specific embodiments and methods have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the use of a selectively communicatable hydraulic nipple. In the interest of clarity, not all features of an actual implementation or related method are described in this specification. It will of course be appreciated that in the development of any such actual embodiment or method, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring to FIG. 1A, one exemplary embodiment of a selectively communicatable hydraulic nipple 10 is illustrated. Nipple 10 is attached below a TRSCSSV 15 in the production tubing string in any suitable manner known in the art. Nipple 10 comprises a bore 12 therethrough and an internal lock profile 14 at its upper end which is used to lock tools in place after they have been landed inside bore 12. Internal lock profile 14 may be any variety of profiles as understood by those skilled in the art. An upper annular flow channel 24 and lower annular flow channel 26 are located along bore 12 below lock profile 14. As shown, the internal diameters of flow channels 24,26 are greater than the internal diameter of polished bore surfaces 17.

An upper communications component 16 and lower communications component 22 extend from the housing 11 of nipple 10 into annular flow channels 24,26, respectively. Initially, upper and lower communications components 16,22 are closed; however, cutting tools can be used to open communications components 16,22 as will be discussed below. Flow channels 24,26 facilitate fluid flow from the communications components 16,22 (once opened) into a flow port of a tool (not shown) in the event the tool's flow port is not radially aligned with the communications component.

Polish bore surfaces 17 of internal bore 14 are located between lock profile 14 and upper flow channel 24, between upper flow channel 24 and lower flow channel 26, and below lower flow channel 26 to seal the annular space above and below flow channels 24,26 once a tool having the appropriate seal assemblies has been inserted inside nipple 10. A threaded connector 30 is located at the upper and lower ends of nipple 10 to allow nipple 10 to be connected to the tubing string above and below. In the most preferred embodiment, for example, connector 30 would be a premium connector having Teflon seals. However, those ordinarily skilled in the art having the benefit of this disclosure recognize any variety of connectors may be utilized.

Further referring to the exemplary embodiment of FIG. 1A, nipple 10 includes a control line connection port 18 at its upper end which receives fluid from a communication control line 19 extending from a surface location. In this embodiment, for example, the control line 19 is hung within the annulus between the upper end of nipple 10 and the wellbore casing. Although not shown, in this embodiment, control line 19 penetrates the tubing hanger above and exits the tubing hanger adapter, whereby it is preferably capped off with a valve, such as a needle valve, so that it can be periodically pressure checked. However, those ordinarily skilled in the art having the benefit of this disclosure understand there are any number of ways to design the wellhead to facilitate the dual control lines of the present invention.

Control line 19 is used to communicate with nipple 10. The TRSCSSV 15 located above nipple 10 also has its own separate control line 13. As such, the tubing hanger of the present invention would be adapted to contain two separate control lines and their corresponding exit points as discussed above. Although only two control lines are discussed herein, those ordinarily skilled in this art having the benefit of this disclosure recognize any number of control lines may be utilized as needed. For example, two nipples could be installed in the tubing string and each would have a separate control line.

In further reference of FIG. 1A, upper communications component 16 and lower communications component 22 are located adjacent annular flow channels 24,26. In the exemplary embodiments illustrated in the Figures, upper and lower communications components 16,22 protrude out into flow channels 24,26 and extend into the housing 11 of nipple 10 to communicate with conduit 20 via sub-conduits 20A and 20B, respectively. Please note, however, that it is not necessary the communications components protrude into channels 24,26. Those skilled in the art having the benefit of this disclosure recognize that any variety of communications components could be utilized within the present invention. Such components can include, for example, rupture discs, burst discs or other communications ports adapted for communication with a downhole tool placed within the nipple.

Conduit 20 extends upward through the housing 11 of nipple 10 to communicate with fluid connection port 18 located at the upper end of nipple 10 where surface communication is achieved via control line 19. In the most preferred embodiment, for example, upper and lower communications components 16,22 can be communication components as disclosed in U.S. Patent Application No. 60/901,225 entitled "Radial Indexing Communication Tool for Subsurface Safety Valve with Communication Device," filed on Feb. 13, 2007 and U.S. Patent Application No. 60/901,187 entitled "Communication Tool for Subsurface Safety Valve with Communication Device," also filed on Feb. 13, 2007, each of which is commonly owned by the assignee of the present invention, BJ Services Company, and each is hereby incorporated by reference in its entirety.

Figure 1B:
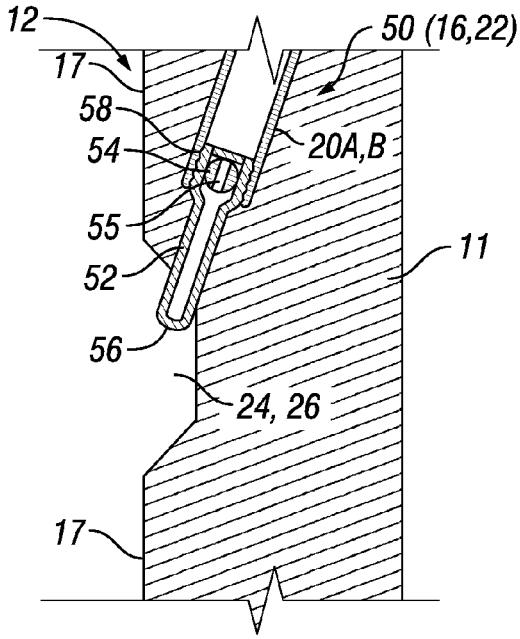
FIG. 1B is a cross-sectional view of an exemplary embodiment of a communications component of the present invention.

Referring to FIG. 1B, an exemplary embodiment of the upper and lower communications components 16,22 is illustrated as communications component 50. Communications component 50 comprises a body 52, communications retention ball 54 having a fluid bypass 55, and a protruding end 56. The communication component 50 is made of a frangible material that may be cut, pierced, sheared, punctured, or the like. External sealing grooves are provided on end 58 of body 52. When the retention ball 54 is pressed into body 52, a high contact pressure, metal to metal seal between the sealing grooves of the body 52 and the conduit 20A,B is established, effectively sealing against leakage. In a preferred embodiment, body 52 is made of 718 Inconel or 625 stainless steel and ball 54 is made of 316 or 625 stainless steel. During normal operations of the nipple 10, the communication component 50 is protected in the sidewall of the nipple housing 11 having a closed protruding end 56. Before communications component 50 becomes operational, a communications tool must be run downhole into nipple 10 in order to cut or puncture protruding end 56, thereby enabling fluid communications through body 52 and fluid bypass 55. In the most preferred embodiment, for example, such a communications tool can be a tool as disclosed in the above referenced patent applications, one of skill recognizing that such a communications tools could be modified as needed to established communication with the desired component 50 of nipple 10.

Further referring to FIG. 1A, sub-conduit 20A is a bi-directional communication passageway which allows fluid to flow freely therethough. However, sub-conduit 20B comprises a check valve 28 which only allows fluid to flow in a downhole direction, thereby preventing fluid from flowing up-hole via lower communications component 22. Any suitable check valve as known in the art may be utilized.

Figure 2:
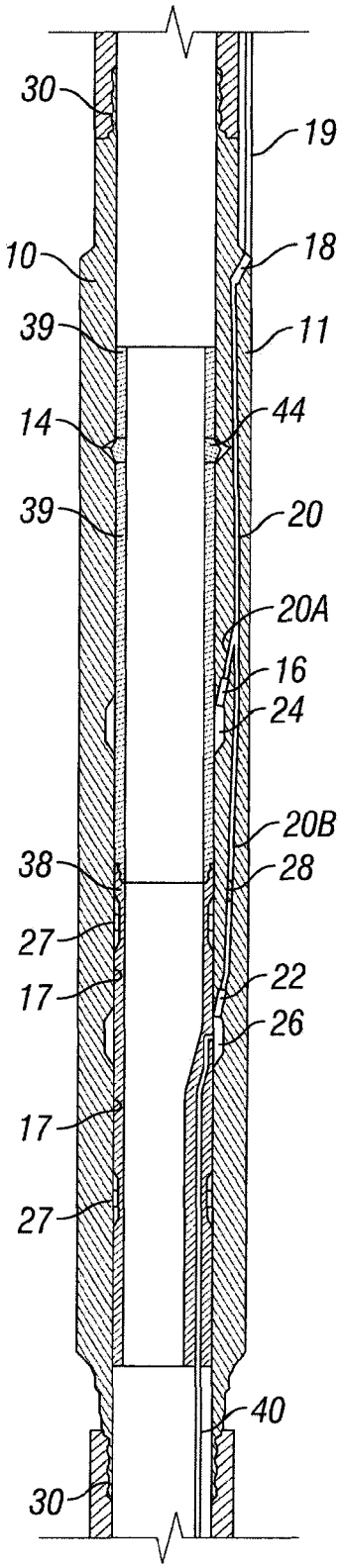
FIG. 2 is a cross-sectional view of the hydraulic nipple of FIG. 1A showing a chemical injection tool inserted therein.

Referring to FIG. 2, nipple 10 of FIG. 1A is illustrated having a chemical injection tool 38 landed therein. In the most preferred embodiment, injection tool 38 can be an Inject-Safe™ Sub-Surface Safety Valve as manufactured by BJ Services Co. of Houston, Tex. As previously discussed, a cutting tool has already been deployed and retrieved to puncture lower communications component 22, thereby enabling fluid communication with injection tool 38. In the preferred embodiment, injection tool 38 may be run into the well via a running tool as known in the art. The upper end of injection tool 38 includes a sleeve 39 having locking mechanism 44 around its outer circumference which mates with locking profile 14, thereby setting injection tool 38 into the proper spaced-out location. Any form of locking mechanism may be used, such as, for example, locking dogs. Alternatively, nipple 10 may include a "no-go" shoulder (not shown) within bore 12 which mates with a profile on sleeve 39, thereby preventing tool 38 from moving further downhole and assisting with the locking function. Those ordinarily skilled in the art having the benefit of this disclosure will understand there are various ways to land tools within nipple 10.

Once injection tool 38 is installed within the wellbore, an operator may selectively communicate with lower communications component 22. As such, chemicals can be injected downhole through control line 19, into communication port 18 of nipple 10, down through conduit 20, sub-conduit 20B, lower communications component 22 and into injection tool 38 which transfers the chemicals to a location downhole via capillary 40 for wellbore treatment. The length of capillary tubing 40 may be selected as needed in order to treat any depth in the well. Check valve 28 prevents backflow up through conduit 20B and control line 19 (and around the TRSCSSV 15 located above nipple 10 and on to the surface). Fluids are prevented from flowing through upper flow channel 24 because upper communications component 16 has not been cut with the cutting tool as previously discussed. Also, annular seals 27 are also placed around the exterior surface of injection tool 38 above and below flow channel 26 to ensure that no fluid is leaked within the annular space between bore 14 of nipple 10 and injection tool 38.

Figure 3:
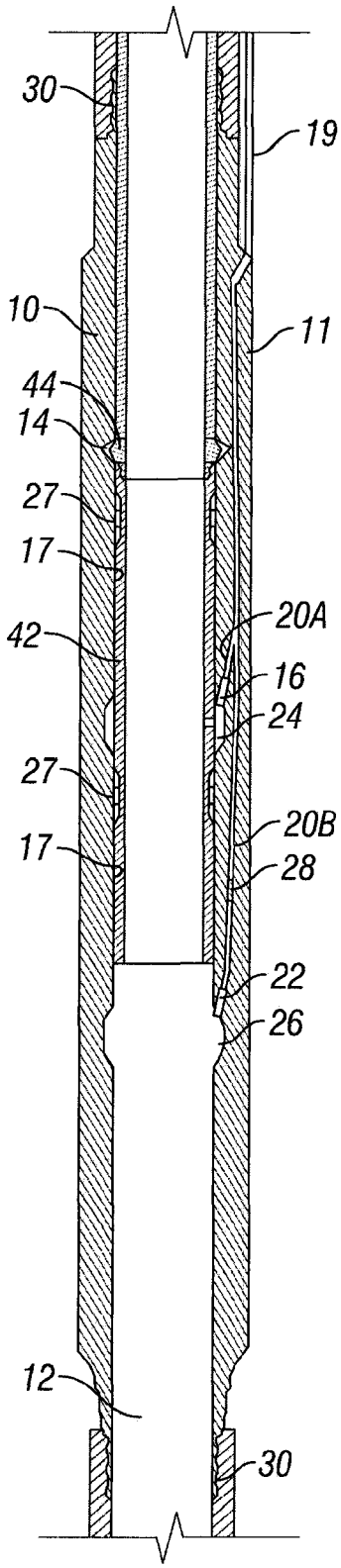
FIG. 3 is a cross-sectional view of the hydraulic nipple of FIG. 1A showing a WRSCSSV inserted therein.

Referring to FIG. 3, nipple 10 of FIG. lA is illustrated having a WRSCSSV 42 landed therein. WRSCSSV 42 is landed using lock profiles 14 or according to any methods known in the art. As previously discussed, before WRSCSSV 42 is run into the wellbore, a cutting tool is deployed and retrieved to cut or puncture upper communications component 16. Once locked into place, an operator can selectively communicate with WRSCSSV 42 via control line 19. In the event the operator experiences a failure of the TRSCSSV 15 uphole from nipple 10 or some other event necessitating need, upper communications component 16 could be selectively communicated, allowing the hydraulic fluid to flow down through control line 19, into communication port 18 of nipple 10, down through conduit 20, sub-conduit 20A, upper communications component 16 and into WRSCSSV 42 thereby actuating the flapper (not shown) of WRSCSSV 42 in an open position. Being that sub-conduit 20A has no check valve therein, the hydraulic fluid may be bled off via communications component 16, thereby closing WRSCSSV when necessary. Also, annular seals 27 are also placed on the exterior of WRSCSSV 42 above and below flow channel 24 to ensure that no fluid is leaked within the annular space between bore 14 of nipple 10 and WRSCSSV 42.

Figure 4A:
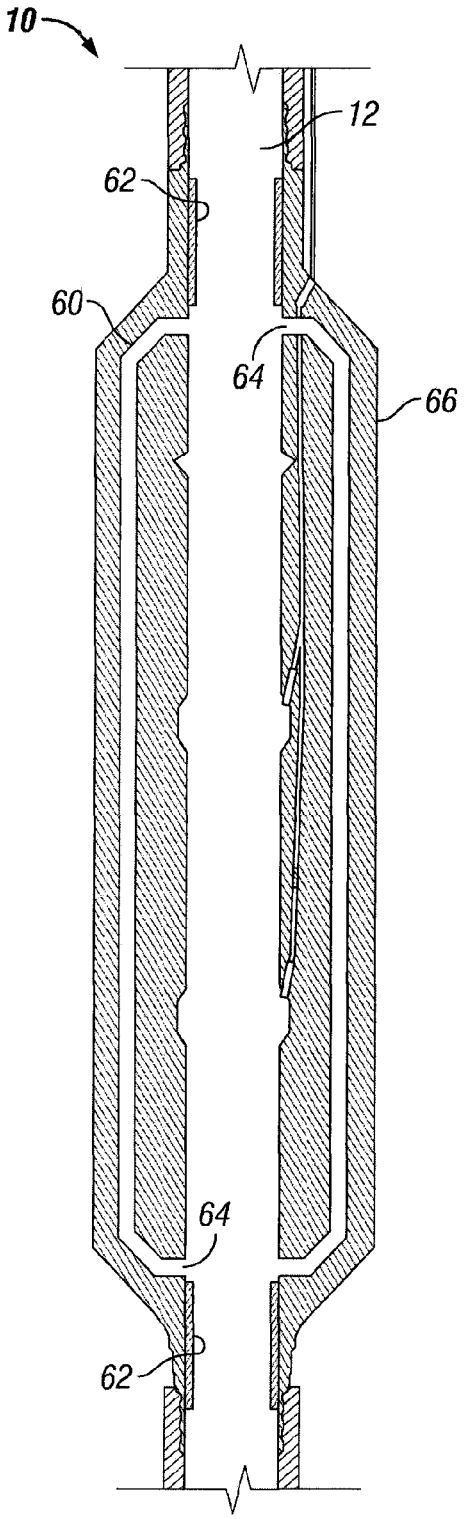
FIG. 4A is a cross-sectional view of a shrouded selectively communicatable hydraulic nipple according to an exemplary embodiment of the present invention.

Referring to FIG. 4A, the selectively communicatable nipple of the present invention is illustrated in an alternative shrouded design as known in the art. Here, nipple 10 has been constructed and operates as previously discussed; however in this alternative embodiment it includes the shroud 66 as part of its integral design. A flow path 60 extending along the length of nipple 10 is provided which allows fluid to flow from bore 12 and around the downhole tools (not shown) which have been landed inside nipple 10. Sliding sleeves 62 are provided along bore 12 at the fluid entry/exits points 64, which can be opened and closed as necessary. The operation of the shroud is known in the art and those skilled in the art having the benefit of this disclosure will appreciate that any variety of shrouds can be utilized with the present invention.

Figure 4B:
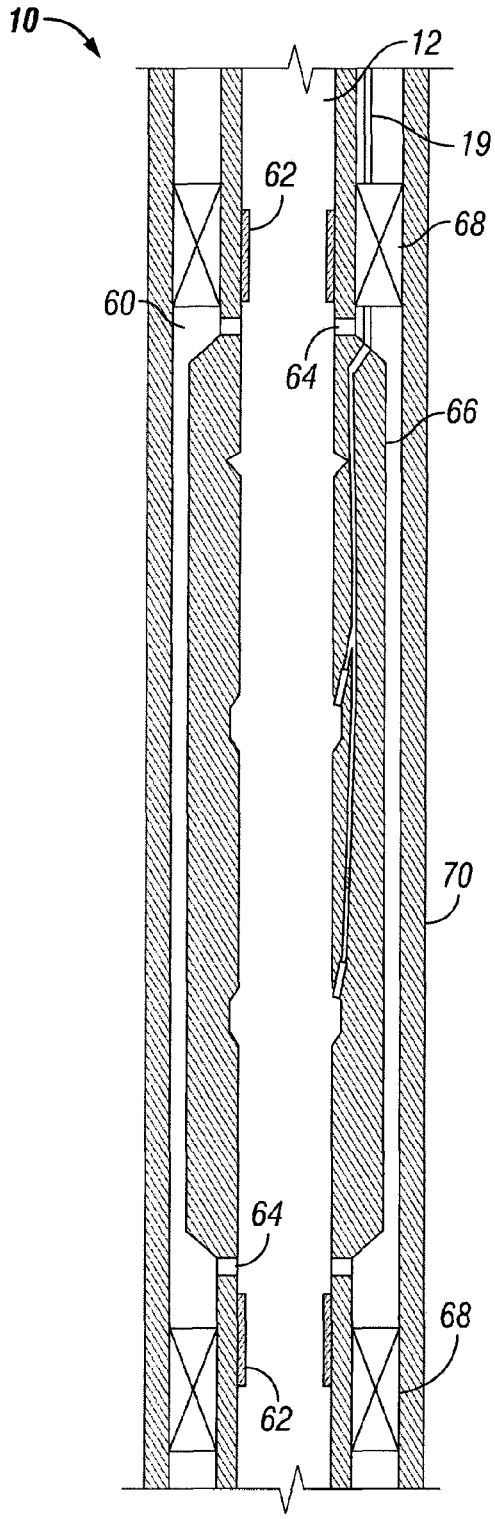
FIG. 4B is a cross-sectional view of an alternate embodiment of the shrouded hydraulic nipple of FIG. 4A.

FIG. 4B illustrates an alternative embodiment of the nipple of FIG. 4A. Here, nipple 10 again has the shroud 66, however, the shroud 66 is created by the annular area between nipple 10 and casing 70 (i.e., flow path 60). Flow path 60 extends above and below nipple 10 and operates as known in the art. A packer 68 is placed above and below shroud 66 to provide sealing functions between nipple 10 and casing 70, also as known in the art. Control line 19 passes through packer 68 as understood in the art and communicates with nipple 10 as previously discussed. An exemplary alternative embodiment of FIGS. 4A & B would include utilizing seals above and below entry/exits points 64 to provide sealing functions across the points 64. Here, polished surfaces would also be necessary above and below entry/exit points 64 as understood in the art. However, those skilled in the art having the benefit of this disclosure realize there are a variety of ways to seal across points 64.

The present invention includes a method for selectively communicating with a hydraulic nipple. A preferred exemplary method includes the steps of positioning the hydraulic nipple within the wellbore beneath a TRSCSSV 15 and selectively communicating with the tool via the second control line. The TRSCSSV 15 is allowed to communicate with a first control line and the hydraulic nipple communicates with a second control line. The method may further include the steps of loosing integrity in the first control line, inserting a WRSCSSV into the nipple and communicating with the WRSCSSV via the second control line.

Yet another preferred exemplary method of the present invention includes the steps of positioning the hydraulic nipple within a wellbore, the hydraulic nipple comprising a first and second communications component in communication with a first control line, and communicating a first fluid through the first control line and into the second communications component. The method may further include the step of subsequently communicating a second fluid through the first control line and into the first communications component.

Accordingly, operators utilizing the present invention at the time of completion or subsequent workover have the ability to take advantage of several options. If chemical injection is needed at any depth in the well, the operator would insert a chemical injection tool, such the InjectSafe™ safety valve, suspending a capillary tubing down to the injection point of interest and selectively communicate with lower communications component 22. Alternatively, if the operator experiences a failure of the TRSCSSV 15 uphole from the nipple 10 or some other event necessitating need, upper communications component 16 would be selectively communicated to allow the insertion of a WRSCCSSV landed within nipple 10. As such, an operator utilizing the present invention can run an injection tool without any wellhead modifications since the control line is already penetrated through the tubing hanger. Moreover, in the event of a safety valve failure due to loss of control line integrity, mechanical damage or scaling, the operator also has the option to run a WRSCSSV within the nipple without the need for costly wellhead modification.

Although various embodiments have been shown and described, the invention is not so limited and will be understood to include all such modifications and variations as would be apparent to one skilled in the art. For example, nipple 10 may contain additional flow channels and corresponding communications components, conduits and control lines in order to facilitate the use and control of two or more downhole tools. Other downhole tools may be hung off nipple 10 including, for example, capillary injection systems or velocity strings. Accordingly, the invention is not to be restricted except in light of the attached claims and their equivalents.

What is claimed is:

1. A hydraulic nipple used in a wellbore, the hydraulic nipple comprising:

a bore extending through the hydraulic nipple, the bore having an upper and lower recess therein;

an upper communications component adjacent the upper recess, the upper communications component communicating with a first control line via a first communications conduit, wherein a portion of the upper communications component protrudes into the upper recess; and a lower communications component adjacent the lower recess, the lower communications components communicating with the first control line via a second communications conduit, wherein the upper and lower communication components are adapted to selectively communicate with one or more tools landed within the bore of the hydraulic nipple and wherein a portion of the lower communications component protrudes into the lower recess.

2. The hydraulic nipple as defined in claim 1, wherein the upper and lower communications components are located within the housing of the hydraulic nipple.

3. The hydraulic nipple as defined in claim 1, wherein the second communications conduit comprises a check valve adapted to prevent fluid flow in an uphole direction.

4. The hydraulic nipple as defined in claim 1, wherein the hydraulic nipple is positioned below a tubing retrievable surface controlled subsurface safety valve ("TRSCSSV"), the TRSCSSV communicating with a second control line.

5. The hydraulic nipple as defined in claim 1, the hydraulic nipple further comprising sealing surfaces above and below the upper and lower annular flow channels.

6. The hydraulic nipple as defined in claim 1, wherein the hydraulic nipple includes a shroud.

7. The hydraulic nipple as defined in claim 1, wherein the upper and lower communications components are comprised of a frangible material.

8. The hydraulic nipple as defined in claim 1, wherein the upper and lower communications components further comprise a communications retention ball having a fluid bypass.

9. The hydraulic nipple as defined in claim 8, wherein the upper and lower communications components further comprise sealing grooves adapted to provide a seal between the communications components and the communications conduits.

10. The hydraulic nipple as defined in claim 1, wherein the portion of the upper and lower communications components that protrudes into the annular flow channel are adapted to be cut, pierced, sheared, or punctured to selectively communicate with the one or more tools.

11. A method for selectively communicating with a tool landed inside a hydraulic nipple within a wellbore, the method comprising the steps of:

(a) positioning the hydraulic nipple within the wellbore beneath a tubing retrievable surface controlled subsurface safety valve ("TRSCSSV"), the TRSCSSV communicating with a first control line extending from the surface and the hydraulic nipple communicating with a second control line extending from the surface, the second control line being separate from the first control line, wherein the hydraulic nipple comprises a first and second communications component adapted to communicate with the second control line; and (b) selectively communicating with the tool via the second control line.

12. The method as defined in claim 11, further comprising the step of communicating chemicals through the second control line and into a chemical injection tool via the second communications component.

13. The method as defined in claim 11, further comprising the step of communicating hydraulic fluid through the second control line and into a wireline retrievable surface controlled subsurface safety valve ("WRSCSSV') via the first communications component.

14. The method as defined in claim 11, the method further comprising the steps of:

loosing integrity in the first control line;

inserting a WRSCSSV into the hydraulic nipple; and communicating with the WRSCSSV via the second control line.

15. A method for selectively communicating with a hydraulic nipple, the method comprising the steps of:

(a) positioning the hydraulic nipple within a wellbore, the hydraulic nipple comprising a first and second communications component in communication with a first control line extending from the surface; and (b) communicating a first fluid through the first control line and into the second communications component, wherein the hydraulic nipple is positioned below a tubing retrievable surface controlled subsurface safety valve ("TRSCSSV"), the TRSCSSV having a second control line extending from the surface, the second control line being separate from the first control line.

16. The method as defined in claim 15, the method further comprising the step of subsequently communicating a second fluid through the first control line and into the first communications component.

17. The method as defined in claim 16, wherein the step of communicating a second fluid through the first control line further comprises the step of communicating the second fluid into a wireline retrievable surface controlled subsurface safety valve ("WRSCSSV') landed inside the hydraulic nipple via the first control line.

18. The method as defined in claim 15, wherein the hydraulic nipple is positioned below a TRSCSSV having a second control line.

19. The method as defined in claim 15, wherein step (b) further comprises the step of communicating the first fluid into a chemical injection tool landed inside the hydraulic nipple, the chemical injection tool delivering fluid to a selected downhole location.

* * * * *